US005531056A

United States Patent [19]

Liang

[11] Patent Number: 5,531,056

[45] Date of Patent: Jul. 2, 1996

[54] METHOD AND APPARATUS FOR STABILIZING CARTONS IN A PACKAGING MACHINE

[75] Inventor: Kun Liang, Marietta, Ga.

[73] Assignee: Riverwood International Corporation, Atlanta, Ga.

[21] Appl. No.: 239,001

[22] Filed: May 6, 1994

[51] Int. Cl.[6] ..... B65B 7/00

[52] U.S. Cl. ..... 53/251; 53/566; 53/201; 53/252; 53/387.2; 493/478

[58] Field of Search ..... 53/566, 201, 387.2, 53/251, 252, 250, 48.1, 458, 467, 473; 493/479, 478, 475

[56] References Cited

U.S. PATENT DOCUMENTS

| | | | |
|---|---|---|---|
| 2,909,874 | 10/1959 | Barr | 53/252 |
| 3,300,947 | 1/1967 | Fahrenbach | 53/48.1 |
| 3,325,977 | 6/1967 | Kirsten | 53/201 |
| 3,481,105 | 12/1969 | Hageline | 53/201 |
| 4,081,945 | 4/1978 | Calvert et al. | 53/201 |
| 4,254,604 | 3/1981 | Vogel et al. | 53/251 |
| 4,358,918 | 11/1982 | Groom et al. | 53/252 |
| 4,554,777 | 11/1985 | Denk et al. | 493/478 |
| 5,359,834 | 11/1994 | Holdensgaard et al. | 53/251 |

*Primary Examiner*—John Sipos
*Assistant Examiner*—Ed Tolan

[57] ABSTRACT

A selectively adjustable apparatus permits the holding down and stabilizing of cartons in a continuous motion packaging machine as grouped articles are inserted into the cartons. The apparatus includes a pair of spaced parallel hold-down rails (56, 62) adapted to engage the tops of moving cartons with light force to hold the cartons down and inhibit their deformation as grouped articles are inserted with significant momentum into the cartons. A side rail (97) is provided and positioned to engage the back ends of the moving cartons to absorb the momentum of grouped articles as the articles are inserted into the cartons. A system of vertical and horizontal guide rails (38, 39, 46, 47, 57, 58), sliding guide blocks (41, 42, 48, 49, 63, 64), brackets (43, 44, 51, 52, 66, 67), and actuators (32, 73, 74) provides for rapid and accurate adjustment of the vertical positions and spacing of the hold-down rails and the transverse position of the side rail and rear hold-down rail to accommodate cartons of virtually any size. Thus, the apparatus can be reconfigured quickly, accurately, and reliably to accommodate a change in carton size necessitated by a change in article size or article group configuration without breakdown and without the resources of a trained technician.

10 Claims, 3 Drawing Sheets

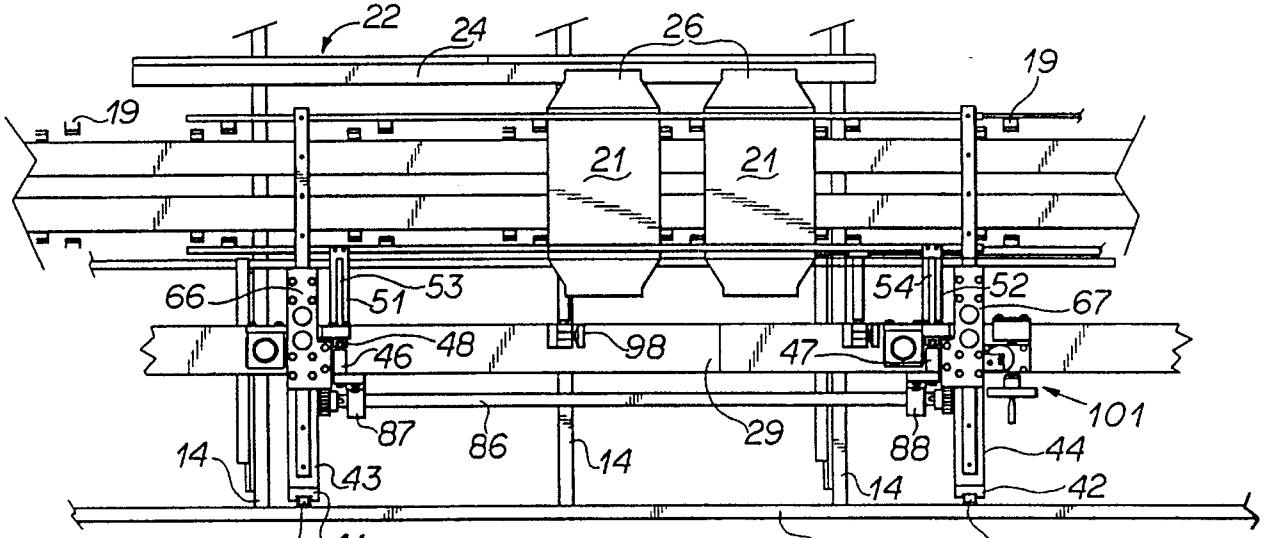
FIG 2
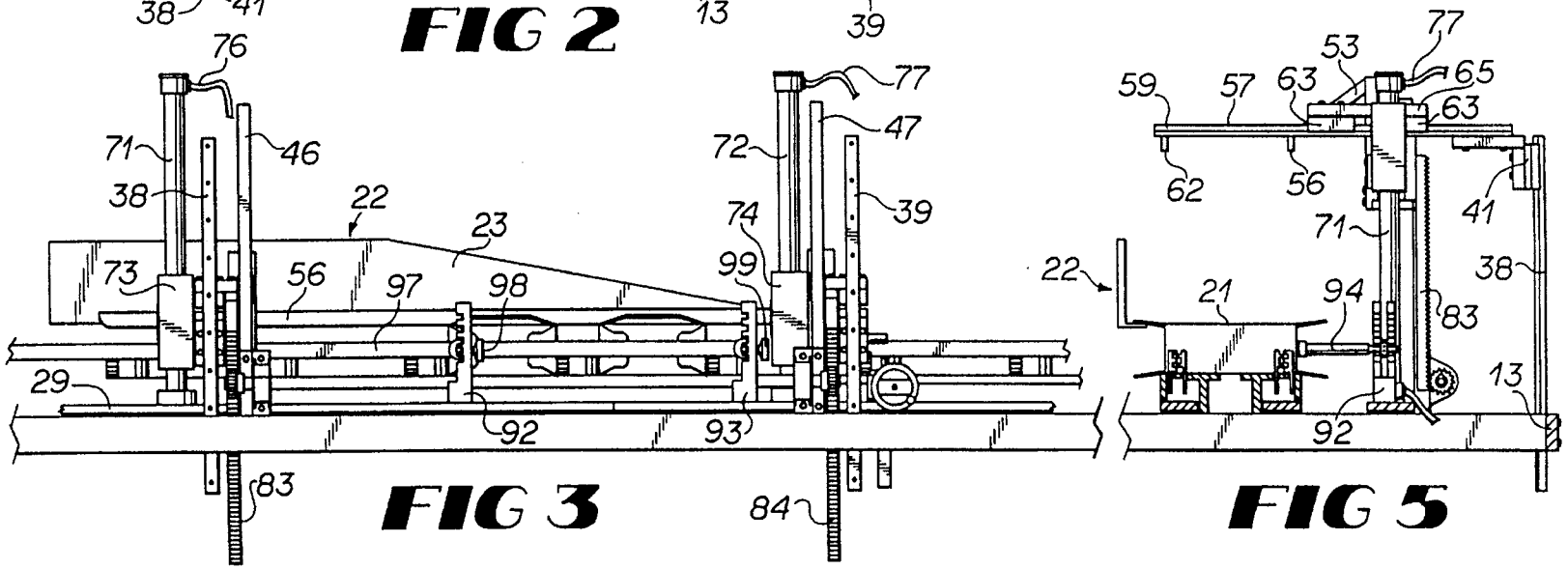
FIG 3
FIG 5

METHOD AND APPARATUS FOR STABILIZING CARTONS IN A PACKAGING MACHINE

FIELD OF THE INVENTION

This invention relates generally to continuous motion industrial packaging machines of the type that form article groups and direct the groups into moving packages or cartons. More particularly, the invention concerns mechanisms for holding down and stabilizing moving cartons in such machines as grouped articles are directed into the cartons.

BACKGROUND OF THE INVENTION

Various types of continuous motion packaging machines are available for packaging articles such as bottles or cans into unitary containers such as paperboard cartons. While varied in detailed operation, such packaging machines function generally to gather articles into groups of a desired size and configuration and insert the grouped articles into the waiting cartons. A well known example of this type of packaging is found in six, twelve, and twenty-four pack cartons of canned soft drinks and beer. Other types of articles, such as bottled drinks and pet food, also are commonly packaged by such machines.

Continuous motion packaging machines can differ markedly in structure and detailed operation. In general, however, such machines function by moving articles and open cartons along adjacent synchronized longitudinal paths. As the articles are moved along, they encounter various guide rails and selector wedges that form the moving articles into moving groups aligned with the moving open cartons. Each group has a predetermined number of articles arrayed in a predetermined configuration. The moving groups of articles are then inserted into the waiting moving cartons. Insertion can be accomplished in a variety of ways, including shoving the grouped articles into cartons with transversely reciprocating paddles or herding the grouped articles gradually into their cartons with skewed guide rails. Once the article groups are inserted into their cartons, the cartons are sealed and conveyed away from the packaging machine.

Examples of continuous motion packaging machines can be found in U.S. Pat. No. 3,778,959 of Langen et al, 4,237,673 of Calvert., et al, 4,887,414 of Arena, and 5,241,806 of Ziegler et al. Ziegler et al discloses a machine wherein articles, once grouped, are shoved into waiting open cartons by reciprocating paddles. In Calvert et al, the grouped articles are herded into open cartons by skewed fixed guide rails. In some machines, such as that disclosed in Arena, grouped articles are moved onto a cardboard blank and the blank is subsequently folded and glued around the article group to form a carton for the articles.

A common requirement in continuous motion packaging machines wherein grouped articles are conveyed into preformed open cartons is that the cartons be stabilized and held down firmly as articles are inserted through their open ends. This is because the packaging machines tend to operate at high speed with many machines having the capability to package 2000 or more articles per minute. As a result, article groups tend to move into the open cartons with significant momentum that can displace or deform the carton if the carton is not stabilized and held firmly in place.

In the past, carton stabilizers on packaging machines typically have included a set of metal hold-down bars or rails mounted to the frame of the machine. These hold-down rails usually extend along and above the longitudinal path of the moving open cartons in the region where articles are inserted into the cartons. The rails are positioned to engage lightly and slidably the tops and, perhaps, the closed ends of the moving cartons as they are conveyed along the longitudinal path. As grouped articles are inserted into the open ends of the cartons, the rails stabilize and hold-down the cartons so that the substantial momentum of and force imparted by the articles does not displace or deform the cartons. In this regard, it has been found that careful spacing and positioning of the rails is critical to insure both adequate carton stabilization and high processing rates.

While such hold-down rail arrangements function adequately to stabilize the open cartons during article insertion, they nevertheless have been plagued with numerous problems and shortcomings inherent in their respective designs. One of the most crucial shortcomings has concerned the ease of adaptability of these hold-down devices to a change in carton size. Most continuous packaging machines can be configured to group and package articles such as beverage cans in a number of different configurations, such as, for example, six, twelve, and twenty-four article cartons. Obviously, when changing from one article configuration to another, the size of the carton required to accommodate the new grouping changes accordingly. Thus, the spacing and positions of the carton hold-down and stabilization rails must be changed to accommodate the new carton size.

Heretofore, such rail adjustment has required that the hold-down assembly be manually torn down and set up anew to accommodate the new carton size. Clearly, such a procedure consumes valuable processing time and requires the attention and resources of technical personnel. The problem is compounded by the critical relationship between carton size and shape and the spacing and positioning of the hold-down rails. If, for example, the rails bear too tightly against the cartons, the resulting friction can itself deform the cartons so that the articles will not move easily into the cartons. On the other hand, if the rails are too loose, the cartons can be deformed, displaced, or even destroyed by the momentum and force of the article groups as they are inserted into the cartons. Because of this critical relationship, it has not been uncommon that a number of wasteful test runs have been required after a reconfiguration to achieve the proper fine adjustment of the newly positioned hold-down rails. Adaptability problems such as these can become particularly acute and costly where article configuration and carton size is changed frequently.

Thus, it is seen that there exists a continuing and as yet unaddressed need for a carton hold-down and stabilization method and apparatus for packaging machines that effectively stabilizes and holds down open moving cartons as articles are inserted into the cartons, that can be adapted quickly, easily, and without the resources of technical personnel to virtually any new article configuration and cartons size, and that, once adapted, performs its function properly with the new carton size without wasteful test runs to accommodate fine adjustment. It is to the provision of such a stabilization and hold-down method and apparatus that the present invention is primarily directed.

SUMMARY OF THE INVENTION

Briefly described, the present invention comprises a highly adaptable carton stabilization and hold-down apparatus for use with continuous motion packaging machines.

The preferred embodiment is configured for use with packaging machines wherein open cartons are conveyed along a longitudinal path with grouped moving articles being shoved, herded, or otherwise inserted into the open ends of the moving cartons.

The apparatus of this invention is mounted on a frame located adjacent to and behind the path of the moving cartons in the region along the path where articles are inserted into the cartons. Art accessory rail is mounted to the frame and extends generally parallel to the path of carton movement. The accessory rail is selectively movable toward and away from the cartons to allow adjustment of the apparatus for cartons of various lengths. A forward pair of spaced parallel guide rails are fixed to the accessory rail and extend upwardly and vertically therefrom. Each of the forward guide rails is provided with a guide block assembly that is vertically slidably mounted to the rail by means of a sliding dovetail joint. A rear pair of vertically extending guide rails are fixed to the frame behind the first pair of guide rails. Each one of the rear vertical guide rails is also provided with a guide block assembly that is vertically slidably mounted to the rail by means of a sliding dovetail joint.

A horizontally extending guide rail is fixed at one end to the guide block assembly of each of the rear vertical guide rails. These horizontal guide rails are parallel and extend transversely relative to the carton path past the forward vertical guide rails to distal ends located above the carton path. A guide block is slidably mounted to each horizontal guide rail and is firmly secured to the guide block assembly of the corresponding forward vertical guide rail. Accordingly, the horizontal guide rails are free to move in the vertical direction by virtue of the four vertical slide block assemblies. Similarly, the forward pair of vertical guide rails and their guide block assemblies are free to move in the transverse direction along with the accessory rail by virtue of the guide blocks of the horizontal guide rails. Appropriate pneumatic and/or mechanical actuators are provided to move the four vertical guide block assemblies and horizontal guide rails to a desired vertical position and to move the forward vertical guide rails and their guide block assemblies to a desired transverse position relative to the carton path.

The guide block assemblies of the forward vertical guide rails are provided with brackets having arms that extend generally transversely to distal ends located above the carton path behind the location of the distal ends of the horizontal guide rails. A forward hold-down rail is fixed to and depends from the distal ends of the horizontal guide rails and extends longitudinally along and above the path of carton movement. Likewise, a rear hold-down rail is fixed to and depends from the distal ends of the bracket arms and extends in spaced parallel relationship with the forward hold-down rail.

The forward and rear hold-down rails extend along the carton path spanning the region where grouped articles are inserted into the cartons. In use, the hold-down rails bear lightly against the tops of moving cartons as grouped articles are inserted to hold the cartons down on the carton conveyor and stabilize them against deformation or displacement as a result of article momentum. Preferably, a side rail assembly is also fixed to the accessory rail and includes a side rail that extends along and engages the back ends of the cartons opposite their open ends. The side rail further stabilizes the cartons by absorbing the impact of grouped articles as The articles move transversely into the cartons from the opposite end.

A distinct advantage of the invention as just summarized is its ease of adaptability and speed of adjustment to accommodate virtually any size carton. For instance, to adjust for a newly sized carton, the transverse actuators are engaged to move the accessory rail forward or backward until the side rail engages the back ends of the new size cartons. This also causes the rear hold-down rail to move transversely until it is located the appropriate predetermined distance forward of the carton rear end. The forward hold-down rail stays fixed a predetermined distance from the front end of the carton. With the side rail and rear hold-down rail transversely adjusted, the vertical actuators are engaged to move the horizontal guide rails, vertical guide block assemblies, and, in turn, the hold-down rails up or down as necessary until the hold-down rails engage lightly the tops of the new size cartons.

With these two simple adjustments completed, the stabilization apparatus is fully adjusted to the new size cartons and poised for immediate operation of the packaging machine. Preferably, counters or other indicators are coupled to the horizontal and vertical actuators so that the hold-down and side rails can be returned to a previously determined desired location accurately and quickly. In this way, adjustments are made precisely the first time and the need for wasteful and time consuming trial runs to fine tune the positions of the hold-down and side rails is eliminated.

It is thus seen that the present invention embodies a unique and highly adaptable stabilization method and apparatus for holding down and stabilizing cartons in modern high speed article packaging machines. The apparatus provides for rapid and precise adjustment of the hold-down and stabilization rails to accommodate a change in article configuration and carton size. Further, the adjustment is highly accurate and repeatable so that wasteful trial runs required to fine tune the rail positions common in the past is completely eliminated. No knock down and reconfiguration of the apparatus is required. Thus, proper and accurate adjustments can be made without the need for the time and resources of a trained technician. These and other objects, features, and advantages of this invention will become more apparent upon review of the detailed description set forth hereinbelow in conjunction with the accompanying drawings, which are briefly described as follows.

BRIEF DESCRIPTION OF THE DRAWINGS

FIG. 2 is a top plan view of the apparatus illustrated in FIG. 1.

FIG. 3 is a side elevational view of the apparatus of FIG. 1 as seen from the rear side thereof.

FIG. 5 is an end elevational view of the apparatus as seen from the left hand end in FIG. 1.

DETAILED DESCRIPTION OF THE PREFERRED EMBODIMENT

Figure 1:
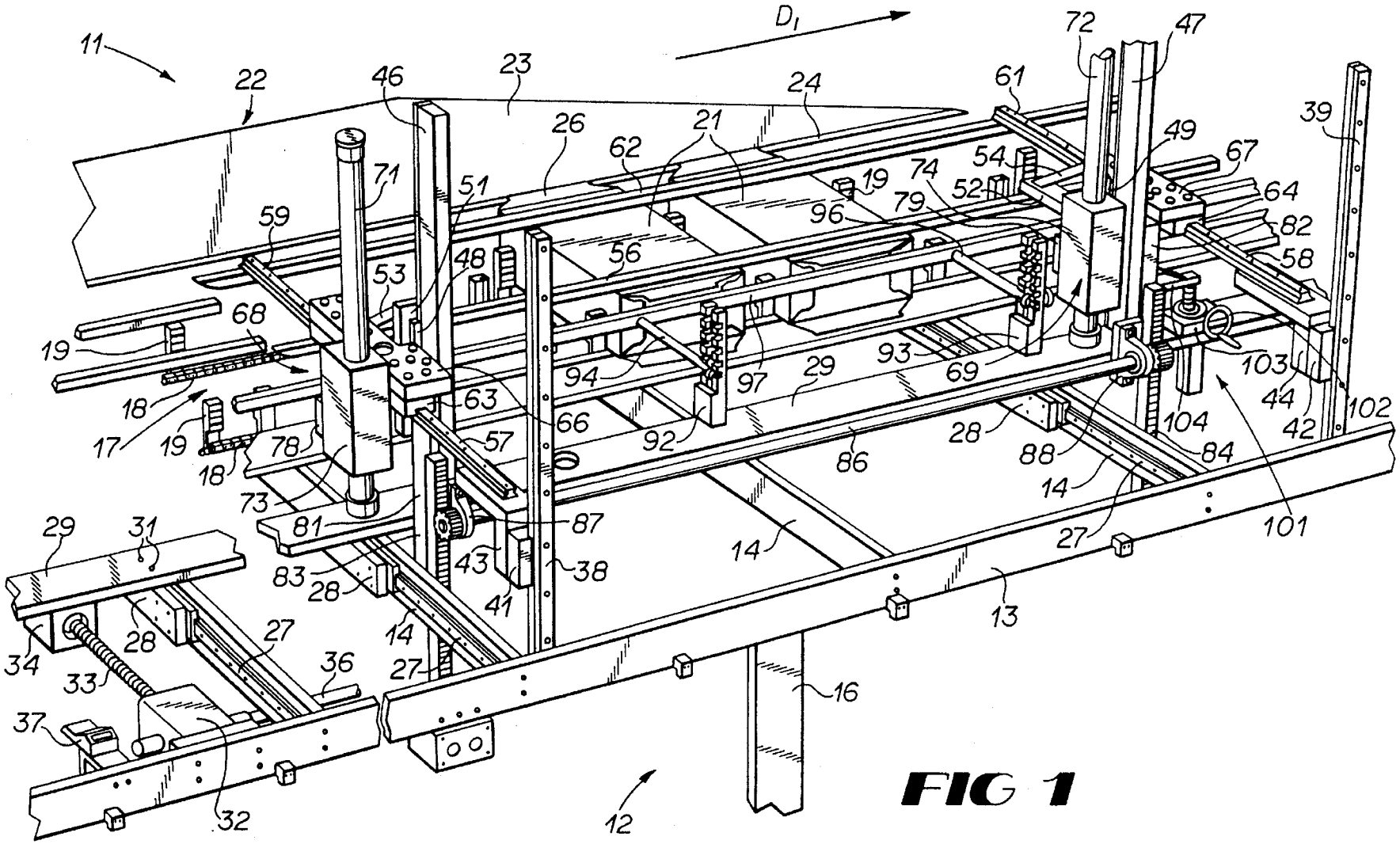
FIG. 1 is a perspective view of a carton hold-down and stabilization apparatus that embodies principals of the present invention in a preferred form.
Figure 4:
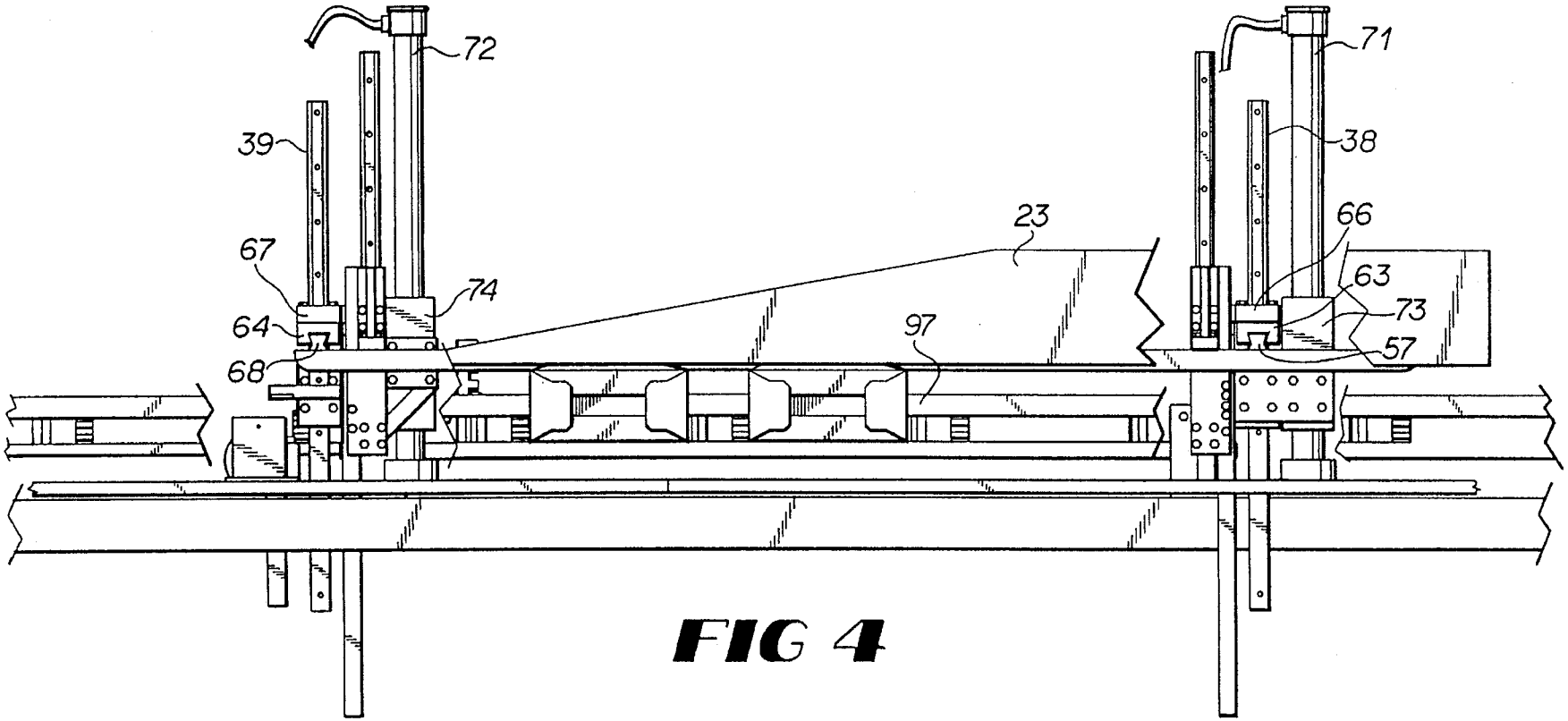
FIG. 4 is a side elevational view of the apparatus of FIG. 1 as seen from the forward side thereof.

Referring now in more detail to the drawings, in which like numerals refer to like parts throughout the several views, FIGS. 1–4 illustrate a stabilization and hold-down apparatus that embodies principals of the present invention in a preferred form. The apparatus 11 comprises a rigid metal side frame 12 having longitudinally extending members 13, transversely extending members 14, and vertical support legs 16. The side frame 12 is configured to support the various functional components of the present invention and is positioned adjacent to the carton transport conveyor of a continuous motion article packaging machine. The carton transport conveyor is generally indicated at 17.

The carton transport conveyor 17 can be of any conventional design but preferably is of the type described in detail in U.S. patent application Ser. No. 08/118,111 of the present inventor. In general, the conveyor comprises endless loop chains 18 co which upstanding retainer lugs 19 are fixed. The upstanding retainer lugs 19 are spaced along the chains 18 to form pockets that receive and position cartons 21 in single file, as best seen in FIGS. 1 and 2. As the chains 18 are driven to move them in the longitudinal direction D1, cartons 21 nestled between upstanding lugs 19 are also conveyed along in direction D1. As detailed in the above-referenced patent application, the transport conveyor 17 is configured so that lugs 19 are adjustable in longitudinal position along the chains 18 to accommodate cartons or containers 21 of different widths.

A generally L-shaped top flap guide 22 is formed with a substantially vertically extending leg 23 and a short horizontally extending leg 24 that extends toward cartons on the transport conveyor 17. As best seen in FIGS. 1 and 2, the top flap guide 22 functions to hold the flaps 26 of cartons 21 open so that grouped articles can be inserted into the cartons from their open ends. The grouping and insertion of articles into the open cartons can be performed by any of a number of article packaging machines such as those disclosed in the U.S. Patents discussed above or as disclosed in applicant's U.S. patent application Ser. No. 08/118,111. The particular apparatus and method of grouping articles and inserting them into the containers is not discussed in detail here and does not form a part of the present invention.

At least some of the transversely extending side frame members 14 are provided with dove-tail shaped guide rails 27 that are mounted to one side of the transverse members 14. Guide blocks 28 are slidably mounted on the guide rails 27 for sliding movement along the lengths of the rails. An accessory rail 29 extends longitudinally of the side frame 12 and is secured by appropriate fasteners 31 to the slidable guide blocks 28. With this arrangement, it can be seen that the accessory rail 29 can be moved by virtue of guide blocks 28 and guide rails 27 transversely toward and away from cartons 21 on the carton transport conveyor 17. An actuator in the form of a gear box 32, threaded screw 33, and threaded bearing block 34 are arranged as shown in FIG. 1 to adjust the transverse position of the accessory rail 29 when the drive shaft 36 is driven by an appropriate motor (not shown).

A counter or measuring device 37 can be coupled to the gear box 32 to provide an indication of the precise location of the accessory rail 29. In this way, the accessory rail 29 can be positioned precisely at a desired transverse position relative to containers on the container transport conveyor or returned to a previously determined position. In practice, the outermost chain 18 of the transport conveyor 17 is also coupled to and moves with the accessory rail 29. In this way, the chains 18 can be moved further apart or closer together by appropriate adjustment of the accessory rail 29 to accommodate longer or shorter cartons respectively.

A pair of rear vertically extending linear guide rails 38 and 39 are fixed to the horizontal member 13 of the side frame 12 and extend upwardly therefrom. Guide blocks 41 and 42 are each mounted to a respective guide rail 38 and 39 by means of a sliding dove-tail joint. The guide blocks 41 and 42 are thus free to move slidably up and down the length of the guide rails 38 and 39. L-shaped brackets 43 and 44 are secured to guide blocks 41 and 42 respectively with the upper leg of each bracket extending inwardly from the guide rails 38 and 39. The guide blocks 41 and 42 in conjunction with the brackets 43 and 44 form vertically movable rear guide block assemblies.

A pair of forward vertically extending linear guide rails 46 and 47 respectively are firmly secured to and extend vertically from the accessory rail 29. It will be understood that the forward guide rails 46 and 47 move laterally toward and away from cartons 21 when the accessory rail 29 is correspondingly adjusted toward and away from the cartons. As with rear guide rails 38 and 39, guide blocks 48 and 49 are coupled to the forward guide rails 46 and 47 by means of a sliding dove-tail joints so that the guide blocks 48 and 49 can slide freely along the vertical length of forward guide rails 46 and 47.

As best illustrated in FIGS. 1 and 2, L-shaped brackets 51 and 52 are secured with bolts to guide blocks 48 and 49 with one leg of each bracket extending forwardly from the corresponding guide rail 46 and 47 to a distal end that overlies the path of carton movement. Angled brace members 53 and 54 extend between and are welded to the legs of brackets 51 and 52 to provide rigid support for the horizontally extending legs of the brackets. Since the brackets 51 and 52 are fixed to guide blocks 48 and 49, the brackets are also free to slide up and down the vertical length of guide rails 46 and 47 along with the guide block.

An elongated metal rear hold-down rail 56 extends between, is mounted to, and depends from the distal ends of the horizontal legs of L-shaped brackets 51 and 52. The rear hold-down rail 56 extends longitudinally over the carton path and functions, as described in more detail below, to engage, hold-down, and stabilize the rear end sections of cartons 21 as the cartons move along and receive grouped articles from the packaging machine.

Transversely extending linear guide rails 57 and 58 are secured at one end to respective L-shaped brackets 43 and 44 and extend horizontally past a corresponding forward vertical guide rail 46 and 47 and across the top of hold-down rail 56 to distal ends 59 and 61 respectively. A longitudinally extending forward hold-down rail 62 is fixed to and depends from the distal ends 59 and 61 of transverse guide rails 57 and 58 and is disposed in spaced parallel relationship relative to the rear hold-down rail 56. The forward hold-down rail 62 functions to engage, hold-down, and stabilize the front end sections of cartons 21 as grouped articles are inserted into the cartons.

Linear guide blocks 63 and 64 are slidably disposed on transverse guide rails 57 and 58 by means of sliding dove-tail joints and are thus free to slide along the lengths of guide rails 57 and 58. Each guide block 63 and 64 is firmly fixed to a respective top bracket 66 and 67 which, in turn, is rigidly and firmly fixed to guide blocks 48 and 49 on the forward vertical guide rails. With this arrangement, the transverse guide rails 57 and 58 are supported intermediate there ends by means of the guide blocks 63 and 64. Furthermore, the entire assembly comprising transverse guide rails 57 and 58, brackets 51 and 52, and hold-down rails 56 and 62 are free to move vertically and in unison as linear guide blocks 41, 42, 48, and 49 slide up and down their respective vertically extending guide rails 38, 39, 46, and 47. Furthermore, as the accessory rail 29 and forward vertical guide rails 46 and 47 fixed thereto are moved toward and away from the carton conveyor, guide blocks 63 and 64 slide along transverse guide rails 57 and 58. This, in turn, moves the rear hold-down rail 56 toward and away from the forward hold-down rail 62, which is transversely fixed at the ends of guide rails 57 and 58. It will thus be appreciated that hold-down rails 56 and 62 are vertically adjustable in unison by virtue of the vertically extending guide rail assemblies and that the horizontal distance between the rear and forward hold-down rails 56 and 62 is adjustable by virtue of the transversely extending guide rail assemblies.

Actuators in the form of rodless pneumatic cylinder assemblies 68 and 69 are mounted to the accessory rail for controlling the vertical positioning of the hold-down rails. The rodless cylinders include cylinder rods 71 and 72 oil which cylinder blocks 73 and 74 are slidably mounted. Such rodless pneumatic cylinder assemblies are well known in the art. In general, a magnet is disposed inside and is slidable along the length of cylinder rods 71 and 72. The magnet attracts cylinder blocks 73 and 74 and pulls the blocks up and down their respective cylinder rods as the magnet moves within the cylinders. Pneumatic fittings 76 and 77 (FIG. 3) allow the magnets within the cylinders to be moved along the lengths of the cylinders by appropriate application of pressurized air on one or both sides of the magnet. Thus, appropriate control of the air causes the cylinder blocks 73 and 74 to move up or down as desired along the lengths of cylinders 71 and 72.

The cylinder rods 71 and 72 are fixed at their bottom ends to the transversely movable accessory rail 29 and extend upwardly therefrom adjacent to forward vertical guide rails 46 and 47 respectively. Cylinder blocks 73 and 74 are firmly fixed by means of brackets 78 and 79 to linear guide blocks 48 and 49. Accordingly, guide blocks 48 and 49 as well as all of the brackets and assemblies fixed thereto are caused to move vertically up and down as the cylinder blocks 73 and 74 are moved by appropriate pneumatic control up and down along cylinder rods 71 and 72. It can therefore be seen that vertical adjustment of the spaced hold-down rails 56 and 62 is accomplished through appropriate pneumatic control of the rodless cylinder assemblies. While pneumatically controlled rodless cylinder assemblies are preferred for controlling vertical adjustment, it should be appreciated that other types of actuators, such as electrically powered gear assemblies, might be employed with comparable results.

vertical brackets 81 and 82 are secured at their upper ends to top brackets 66 and 67 respectively and extend downwardly therefrom adjacent to the forward vertical guide rails 46 and 47. Rack gears 83 and 84 are fixed to vertical brackets 81 and 82 and extend downwardly therefrom as best illustrated in FIGS. 1 and 5. A horizontal drive shaft 86 extends through bearing blocks 87 and 88 fixed to the accessory rail 29 and is provided on its ends with pinion gears 89 and 91 that are mated with the rack gears 83 and 84. The purpose of this rack and pinion gear assembly is twofold. First, it couples all of the vertically movable components on one side of the apparatus to the corresponding vertically movable components on the other side of the apparatus. Accordingly, as the components on one side move vertically, this motion is transferred through the drive shaft and rack and pinion gear assemblies to the vertically movable components on the other side. This ensures that vertical movement on both sides occurs simultaneously and precisely at the same rate and to the same extent. Hold-down rails 56 and 62 are therefore maintained in a horizontal orientation as they are adjusted vertically. The second purpose of the rack and pinion gear assembly is to allow the apparatus to be adjusted using only one of the rodless pneumatic cylinder actuators if desired. In such a scenario, the vertical adjusting force provided on one side by one cylinder is transferred through the delve shaft and rack and pinion gears to the other side of the apparatus causing its elements to move vertically in unison with the driven side.

A pair of adjustable side rail supports 92 and 93 are fixed to and extend upwardly from the accessory rail 29. The side rail supports are formed with grooves and notches that receive and hold the ends of transversely extending bars 94 and 96. An elongated side rail 97 is secured to the distal ends of the rods 94 and 96 and extends longitudinally in spaced parallel relationship to and below the level of the rear hold-down rail 56. The purpose of the side rail 97 is to engage and secure the back ends of cartons 21 and to absorb the lateral momentum and force of grouped articles as they are moved rapidly into the cartons. The side rail 97 thus functions to stabilize the cartons and prevent them from being laterally displaced by the force of the rapidly moving articles.

The vertical position of side rail 97 can be adjusted by removing securing bolts 98 and 99 (FIG. 3), moving the bars 94 and 96 to a higher or lower notch, and replacing the securing bolts 98 and 99 to secure the bar in its new location. The vertical adjustment can also be accomplished in a variety of other ways if desired. Such vertical adjustment of the side rail 97 may be necessary, for example, where articles of a different height dictate a carton having a taller or shorter profile. Since the side rail supports 92 and 93 are fixed to the accessory rail 29, lateral adjustment of the side rail 97 to accommodate a new carton length occurs automatically when the accessory rail 29 is moved to adjust the lateral position of the rear hold-down rail 56 and the rear chain of the conveyor assembly 17.

A mechanical stop assembly 101 is provided for positioning the hold-down rails 56 and 62 at proper vertical positions to accommodate various height cartons. The stop assembly 101 includes a manual crank 102 that, when appropriately rotated, raises and lowers a stop bar 103. An electrically powered actuator might be employed with comparable results. A stop block 104 is secured to the vertical bracket 82 and is thus coupled to the guide block on forward vertical guide rail 47. The stop block is positioned to engage the stop bar 103 to inhibit downward movement of the entire assembly past a preset level determined by the position of the bar top. The hold-down rails 56 and 62 can thus be located at a vertical position determined by the position of stop bar 103. A counter (not shown) is coupled to the stop assembly 101 so that the vertical height of the assembly and the hold-down bars can be set precisely by adjusting the stop assembly until a desired predetermined value appears on the counter. The counter can be used to reposition the assembly at a previously determined desired location by moving the assembly until the value corresponding to such position appears on the counter.

In operation of the apparatus of this invention, open cartons are loaded on the carton conveyor at an upstream location to the left in FIG. 1. Prior to such loading, the accessory rail 29 has been moved to the appropriate lateral location to adjust the positions of the rear conveyor chain, the side rail, and the rear hold-down rail to accommodate the length of the cartons. In addition, the vertical locations of the hold-down rails have been set as appropriate to accommodate the height of the cartons. The cartons are then held down and properly stabilized as grouped articles are inserted into them.

When it becomes necessary to change the article group configuration and thus the carton size, one simply sets the accessory rail to the appropriate lateral position using the gear box assembly 32 and counter 37 and sets the vertical positions of the hold-down rails as appropriate using the rodless cylinders and vertical position counter. With these two simple adjustments, all functional elements of the carton stabilization apparatus are set accurately and the packaging machine can be started to package articles in the newly sized cartons.

The invention has been described herein in terms of preferred embodiments and methodologies. It will be obvious to those of skill in the art, however, that embodiments other than these specifically illustrated might well be employed in the context of the invention. Thus, various modifications, additions, and deletions might well be made to the illustrative embodiments without departing from the spirit and scope of the invention as set forth in the following claims.

I claim:

1. In a continuous motion article packaging machine wherein grouped articles and cartons having open ends and back ends are conveyed along aligned synchronized paths and the grouped articles are inserted into the open ends of the moving cartons, the improvement comprising a carton hold-down and stabilization apparatus having hold-down means for engaging the cartons from above to hold the cartons down as the grouped articles are inserted into the cartons and barrier means for engaging the back ends of the cartons to stabilize the cartons against lateral displacement as the grouped articles are inserted into the cartons, said apparatus further including vertical adjustment means for selectively adjusting the vertical position of said hold-down means and lateral adjustment means for selectively adjusting the lateral position of said barrier means, said hold-down means comprising a forward hold-down rail for engaging the cartons a predetermined distance from the open ends thereof and a rear hold-down rail disposed in spaced substantially parallel relationship with said forward hold-down rail for engaging the cartons a predetermined distance from the back ends thereof, said lateral adjustment means including means for adjusting the lateral position of said rear hold-down rail along with the barrier means to reset the spacing between the forward and rear hold-down rails as the barrier means is adjusted, said lateral adjustment means including an accessory rail movably mounted to said apparatus for selective lateral movement toward and away from the rear ends of moving cartons on said packaging machine, said barrier means being mounted to said accessory rail, and a pair of spaced forward guide rails fixed to and extending upwardly from said accessory rail, each of said forward guide rails bearing a bracket assembly having an arm that extends forwardly to a distal end that overlies the path of moving cartons on the packaging machine, said rear hold-down rail extending between and being secured to the distal ends of said arms of said bracket assemblies whereby lateral displacement of said accessory rail causes corresponding lateral adjustment of said barrier means and said rear hold-down rail.

2. The packaging machine of claim 1, said bracket assemblies being vertically slidably mounted to said forward guide rails to provide for selective vertical adjustment of said rear hold-down rail.

3. The packaging machine of claim 2, and further comprising coupling means for coupling said bracket assemblies together for synchronized vertical movement thereof.

4. The packaging machine of claim 3, said coupling means comprising a rack gear secured to each of said bracket assemblies, a shaft rotatably mounted to said apparatus extending substantially between said rack gears, and a pinion gear secured to each end of said shaft and being coupled to a corresponding one of said rack gears, vertical movement of one of said bracket assemblies along its guide rail being transferred through said shaft to cause simultaneous synchronized vertical movement of the other bracket assembly, said bracket assemblies moving up and down together so that the rear hold-down rail is maintained in a substantially horizontal orientation as it is adjusted vertically.

5. The packaging machine of claim 4, and further comprising actuator means coupled to at least one of said bracket assemblies for moving said bracket assemblies to a desired predetermined vertical position along their vertical guide rails.

6. The packaging machine of claim 5, said actuator means comprising a pneumatically controlled rodless cylinder coupled between said accessory rail and said at least one bracket assembly.

7. The packaging machine of claim 2, and further comprising a pair of spaced rear guide rails secured to said apparatus and extending upwardly therefrom behind said forward guide rails, a bracket assembly vertically slidably mounted to each one of said rear guide rails, and a pair of horizontal guide rails each secured at one end to a respective one of said rear guide rail bracket assemblies and extending transversely relative to the carton path past a corresponding one of said forward guide rails to a distal end overlying the carton path, each of said horizontal guide rails being slidably secured intermediate its ends to a corresponding one of said forward guide rail bracket assemblies, said forward hold-down rail extending between and being secured to the distal ends of said horizontal guide rails, said hold-down rails being adjusted vertically in unison and said rear guide rail and said barrier means can be adjusted laterally.

8. An apparatus for holding down and stabilizing cartons having opposed ends as the cartons move along a longitudinal path, said apparatus comprising:

a frame;

hold-down means on said frame for engaging from above moving cartons to hold the cartons down as they move along the longitudinal path;

said hold-down means including a forward hold-down rail extending parallel to the path of carton movement adjacent one side of the path and a rear hold-down rail spaced from said forward hold-down rail and extending parallel to the path of carton movement adjacent the opposite side of the path, said hold-down rails being sized and positioned to engage from above cartons moving along the path to hold the cartons down on the path;

vertical adjustment means on said frame for simultaneously adjusting the vertical positions of said forward and rear hold-down rails to accommodate cartons of differing height;

transverse adjustment means on said frame for adjusting a spacing between said forward and rear hold-down rails to accommodate cartons of differing length;

barrier means on said frame with said barrier means having a side rail positioned to engage one of the opposed ends of cartons moving along the path to stabilize the cartons laterally on the path;

said barrier means being coupled to said transverse adjustment means so that said side rail is simultaneously adjusted with adjustment of the spacing between said forward and rear hold-down rails to accommodate cartons of differing length.

9. An article packaging machine wherein cartons having forward ends and rear ends are conveyed along a longitudinal path with articles being inserted into the front ends of the cartons as they move along the path, said packaging machine comprising:

a first hold-down rail extending parallel to the path of carton movement for engaging the tops of cartons moving along the path;

an end rail extending parallel to the path of carton movement for engaging the rear ends of cartons moving along the path;

lateral adjustment means coupled to said first hold-down rail and to said end rail for adjusting the lateral position of said end rail relative to the path of carton movement while simultaneously adjusting the lateral position of said first hold-down rail relative to the path of carton movement to accommodate cartons of different sizes;

vertical adjustment means coupled to said first hold-down rail for adjusting the vertical position of said first hold-down rail relative to said carton path; and wherein said lateral adjustment means includes an accessory rail mounted to said packaging machine for selective lateral movement toward and away from the path of carton movement, said end rail and said first hold-down rail being coupled to said accessory rail for coordinated movement therewith.

10. The packaging machine of claim 9 and further comprising a second hold-down rail on said machine extending in spaced parallel relationship to said first hold-down rail over the path of carton movement for engaging the tops of cartons moving along the path, lateral adjustment of said first hold-down rail with said lateral adjustment means causing a corresponding adjustment in the spacing between said first hold-down rail and said second hold-down rail.

* * * * *